US011372350B2

(12) United States Patent
Miyake et al.

(10) Patent No.: US 11,372,350 B2
(45) Date of Patent: Jun. 28, 2022

(54) IMAGING APPARATUS INCLUDING POWER SOURCE TO SUPPLY ELECTRICAL BIAS TO TRANSFER ROLLER AND CONDUCTIVE DEVICE

(71) Applicant: Hewlett-Packard Development Company, L.P., Spring, TX (US)

(72) Inventors: Koji Miyake, Yokohama (JP); Satoru Furuya, Yokohama (JP); Shun Ikeura, Yokohama (JP); Satoru Hori, Yokohama (JP); Naoyuki Iwata, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/297,693

(22) PCT Filed: Jun. 17, 2020

(86) PCT No.: PCT/US2020/038141
§ 371 (c)(1),
(2) Date: May 27, 2021

(87) PCT Pub. No.: WO2020/257287
PCT Pub. Date: Dec. 24, 2020

(65) Prior Publication Data

US 2022/0100124 A1 Mar. 31, 2022

(30) Foreign Application Priority Data

Jun. 18, 2019 (JP) ..... JP2019-112632

(51) Int. Cl.
*G03G 15/16* (2006.01)

(52) U.S. Cl.
CPC ..... *G03G 15/161* (2013.01); *G03G 15/1665* (2013.01)

(58) Field of Classification Search
CPC ..... G03G 15/161; G03G 15/168; G03G 15/1645; G03G 15/1675
USPC ..... 399/66, 101, 353
See application file for complete search history.

(56) References Cited

U.S. PATENT DOCUMENTS

| | | | |
|---|---|---|---|
| 7,127,191 | B2 | 10/2006 | Mori et al. |
| 8,041,243 | B2 | 10/2011 | Matsushita et al. |
| 9,037,021 | B2 | 5/2015 | Yamaura et al. |
| 11,009,815 | B2 * | 5/2021 | Matsuzaki et al. .. G03G 15/161 |

(Continued)

FOREIGN PATENT DOCUMENTS

| | | |
|---|---|---|
| JP | 1996220902 | 8/1996 |
| JP | 2004310060 A | 11/2004 |

(Continued)

*Primary Examiner* — William J Royer
(74) *Attorney, Agent, or Firm* — Jefferson IP Law, LLP

(57) ABSTRACT

An imaging apparatus includes a transfer belt, a transfer roller, a conductive roller, and a power source. The transfer roller includes a metal shaft electrically floating during an imaging operation. The conductive roller has an electrical resistance lower than an electrical resistance of the transfer roller. The power source is electrically connected to the conductive roller, and the power source includes a first supply path to supply a first electrical bias to the conductive roller during an imaging operation and a second supply path to supply a second electrical bias to the transfer roller during a cleaning operation.

20 Claims, 14 Drawing Sheets

(56) References Cited

U.S. PATENT DOCUMENTS

| | | | | |
|---|---|---|---|---|
| 2005/0207779 | A1* | 9/2005 | Takahashi et al. .. | G03G 15/168<br>399/101 |
| 2012/0170952 | A1* | 7/2012 | Ai ..... | G03G 15/161<br>399/101 |
| 2017/0205754 | A1* | 7/2017 | Tabata ..... | G03G 15/1675 |

FOREIGN PATENT DOCUMENTS

| | | |
|---|---|---|
| JP | 2008310218 | 12/2008 |
| JP | 2010151943 | 7/2010 |
| JP | 2015045739 | 3/2015 |
| JP | 2018124408 | 8/2018 |

* cited by examiner

IMAGING APPARATUS INCLUDING POWER SOURCE TO SUPPLY ELECTRICAL BIAS TO TRANSFER ROLLER AND CONDUCTIVE DEVICE

An imaging apparatus includes an image carrier carrying a toner image, a transfer roller contacting the image carrier, and a power supply roller applying a current to the transfer roller. The transfer roller has a conductive axis. Ion conductive materials such as epichlorohydrin rubber are used in the transfer roller. The image carrier is grounded and the power supply roller is connected to a transfer electrical bias power source. A transfer current is supplied from the transfer electrical bias power source to a shaft of the transfer roller through the power supply roller.

DETAILED DESCRIPTION

In the following description, with reference to the drawings, the same reference numbers are assigned to the same components or to similar components having the same function, and overlapping description is omitted.

Figure 1:
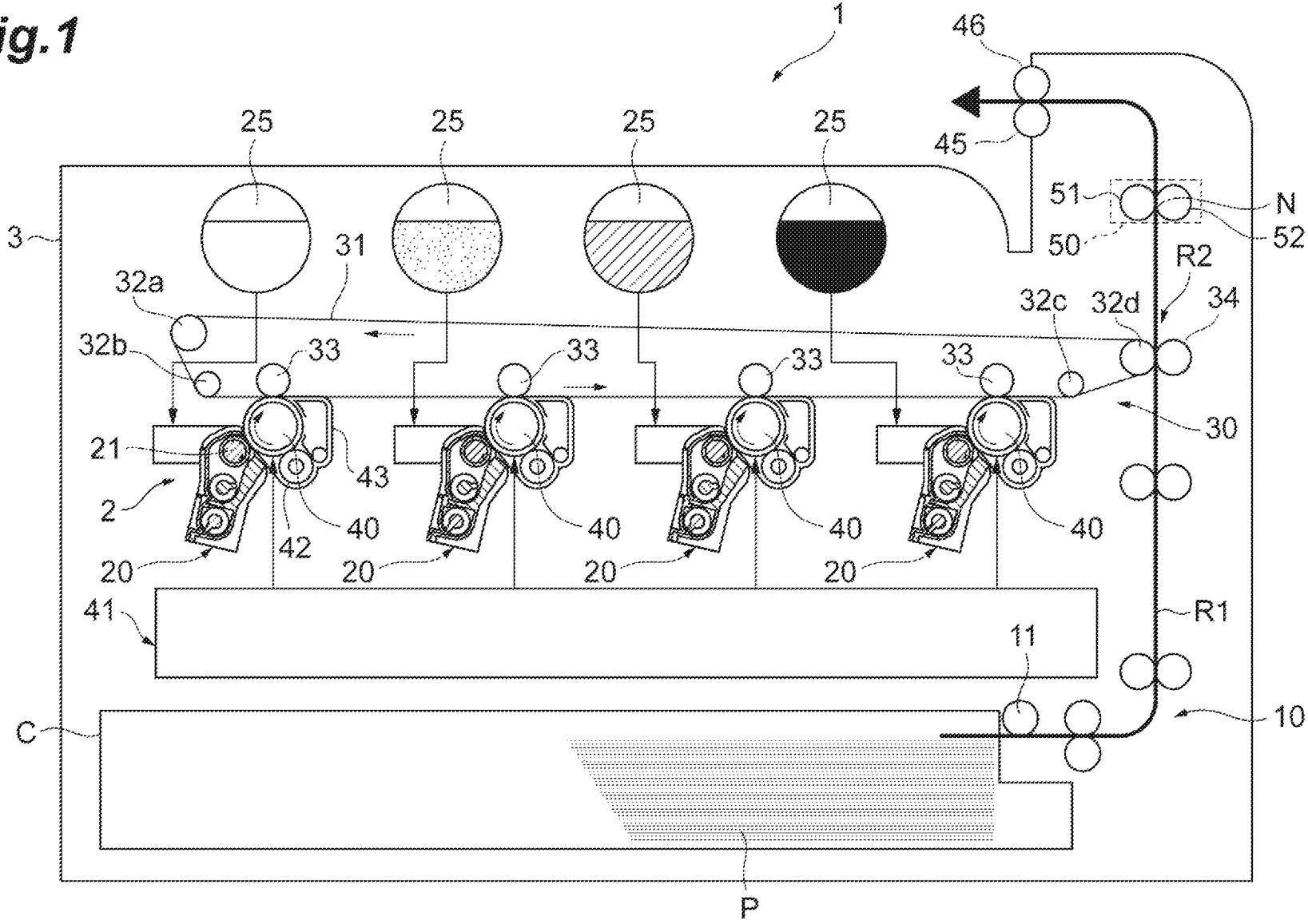
FIG. 1 is a schematic diagram of an imaging apparatus including an example transfer unit or device.

With reference to FIG. 1, an example imaging apparatus 1 may form a color image by using respective colors of magenta, yellow, cyan, and black. The imaging apparatus 1 may include, for example, a printing medium conveying device 10, a plurality of developing devices 20, a transfer unit (or transfer device) 30, a plurality of photosensitive members 40, and a fixing device 50. The printing medium conveying device 10 conveys a printing medium P. The printing medium P may include a sheet of paper for example. The photosensitive member 40 forms an electrostatic latent image and the developing device 20 develops the electrostatic latent image, into a toner image. The toner image is primarily transferred onto the transfer unit or device 30. The transfer unit 30 secondarily transfers the toner image onto the printing medium P. The fixing device 50 may fix the toner image onto the printing medium P.

As an example, the printing medium conveying device 10 may include a feeding roller 11 which conveys the printing medium P having an image formed thereon along a conveyance path R1. The printing media P are stacked and accommodated in a cassette C and are picked up and conveyed by the feeding roller 11. The feeding roller 11 is provided in the vicinity of, for example, an exit of the printing medium P in the cassette C. The printing medium conveying device 10 causes the printing medium P to reach a secondary transfer region R2 through the conveyance path R1 at a timing in which a toner image transferred onto the printing medium P reaches the secondary transfer region R2.

In some examples, one developing device 20 is provided for each color. Each developing device 20 includes a developing roller 21 which carries toner on the photosensitive member 40. In the developing device 20, for example, the toner (e.g., toner particles) and the carrier (e.g., carrier particles) are adjusted to a predetermined mixing ratio and the toner and the carrier are mixed and stirred so as to uniformly disperse the toner. The mixed toner and carrier form a developer which is carried on the developing roller 21. The developing roller 21 rotates so that the developer is conveyed to a region facing the photosensitive member 40. Then, the toner in the developer carried on the developing roller 21 moves to the electrostatic latent image of the photosensitive member 40 so that the electrostatic latent image is developed.

The transfer device 30 may convey, for example, the toner image formed by the developing device 20 and the photosensitive member 40 to the secondary transfer region R2. An image developed by, for example, the photosensitive member 40 is primarily transferred onto the transfer device 30. As an example, the transfer device 30 may include a transfer belt 31, tension rollers 32*a*, 32*b*, 32*c*, and 32*d*, a transfer roller 33 corresponding to a primary transfer roller, and a transfer roller 34 corresponding to a secondary transfer roller.

The transfer belt 31 is tensioned by, for example, the tension rollers 32*a*, 32*b*, 32*c*, and 32*d*. In some examples, one transfer roller 33 is provided for each color. Each one of the transfer rollers 33 presses the transfer belt 31 against an adjacent one of the photosensitive members 40. The transfer roller 34 presses the transfer belt 31 against the tension roller 32*d*.

The transfer belt 31 is, for example, an endless belt which is moved in a circulating manner by the tension rollers 32*a*, 32*b*, 32*c*, and 32*d*. The transfer roller 33 presses against the photosensitive member 40 from the inner peripheral side of the transfer belt 31. The transfer roller 34 presses against the tension roller 32*d* from the outer peripheral side of the transfer belt 31. The photosensitive member 40 may be a photosensitive drum as an example and one photosensitive member 40 may be provided for each color. A plurality of the photosensitive members 40 are arranged along the movement direction of the transfer belt 31. The developing device 20, an exposure unit 41, a charging device 42, and a cleaning device 43 are positioned to face the outer peripheral surface of each photosensitive member 40.

The example imaging apparatus 1 includes a process cartridge 2 and a housing 3. The process cartridge 2 includes the developing device 20, the photosensitive member 40, the charging device 42, and the cleaning device 43, and the process cartridge 2 is removably attached to the housing 3. The housing 3 includes a door that can be opened to insert and remove (or detach) the process cartridge 2 into and from the housing 3 through the door.

In an example operation, the charging device 42 uniformly charges the outer peripheral surface of the photosensitive member 40 to a predetermined potential. The charging device 42 may be a charging roller that rotates to follow the rotation of the photosensitive member 40. The exposure unit 41 exposes the outer peripheral surface of the photosensitive member 40 charged by the charging device 42 in response to an image formed on the printing medium P. A potential of a portion exposed by the exposure unit 41 in the outer peripheral surface of the photosensitive member 40 changes, so that an electrostatic latent image is formed on the outer peripheral surface of the photosensitive member 40.

In the example imaging apparatus 1, the plurality of developing devices 20 are positioned to face respective toner tanks 25. For example, magenta, yellow, cyan, and black toners are stored in the respective toner tanks 25. The toner is supplied from each toner tank 25 to each developing device 20. Each developing device 20 forms a toner image on the outer peripheral surface of the corresponding (adjacent) photosensitive member 40 by developing the electrostatic latent image using the supplied toner. The toner image formed on the outer peripheral surface of the photosensitive member 40 is primarily transferred to the transfer belt 31 and the toner remaining on the outer peripheral surface of the photosensitive member 40 after the primary transfer operation has completed, is removed by the cleaning device 43.

The fixing device 50 may fix onto the printing medium P, the toner image that has been secondarily transferred from the transfer belt 31 onto the printing medium P. As an example, the fixing device 50 includes a heating roller 51 and a pressing roller 52. The heating roller 51 heats the printing medium P and fixes the toner image onto the printing medium P. The pressing roller 52 presses against the heating roller 51. Both of the heating roller 51 and the pressing roller 52 may be formed in, for example, a cylindrical shape.

As an example, a heat source such as a halogen lamp may be provided inside the heating roller 51. In addition, a heat source such as a halogen lamp may be provided inside the pressing roller 52. A nip N which is a fixing region of the printing medium P is formed between the heating roller 51 and the pressing roller 52. When the printing medium P passes through the nip N, the toner image is melted and fixed onto the printing medium P.

As an example imaging method an example of a printing operation carried out by the imaging apparatus 1 will be described. When an image signal of an image to be printed is input to the imaging apparatus 1, the printing media P stacked on the cassette C are picked up as the feeding roller 11 rotates and the printing media P are conveyed along the conveyance path R1. Then, the charging device 42 uniformly charges the outer peripheral surface of the photosensitive member 40 to a predetermined potential on the basis of the image signal. Then, the exposure unit 41 irradiates a laser light to the outer peripheral surface of the photosensitive member 40 so as to form an electrostatic latent image on the outer peripheral surface of the photosensitive member 40.

The developing device 20 performs a developing operation by forming the toner image on the photosensitive member 40. The toner image is primarily transferred from each photosensitive member 40 to the transfer belt 31 at a region of the photosensitive member 40 that faces the transfer belt 31. For example, the toner images respectively formed on the photosensitive members 40 are sequentially layered onto the transfer belt 31 so that a single composite toner image is formed. The composite toner image is secondarily transferred onto the printing medium P conveyed from the printing medium conveying device 10 at the secondary transfer region R2 between the tension roller 32*d* and the transfer roller 34 (e.g., where the tension roller 32*d* faces the transfer roller 34).

The printing medium P onto which the composite toner image is secondarily transferred is conveyed from the secondary transfer region R2 to the fixing device 50. The fixing device 50 melts and fixes the composite toner image onto the printing medium P by applying, for example, a heat and a pressure to the printing medium P passing through the nip N. The printing medium P passing through the nip N of the fixing device 50 is discharged to the outside of the imaging apparatus 1 by, for example, discharging rollers 45 and 46.

An example of the transfer unit (or transfer device) 30 will be described.

Figure 2:
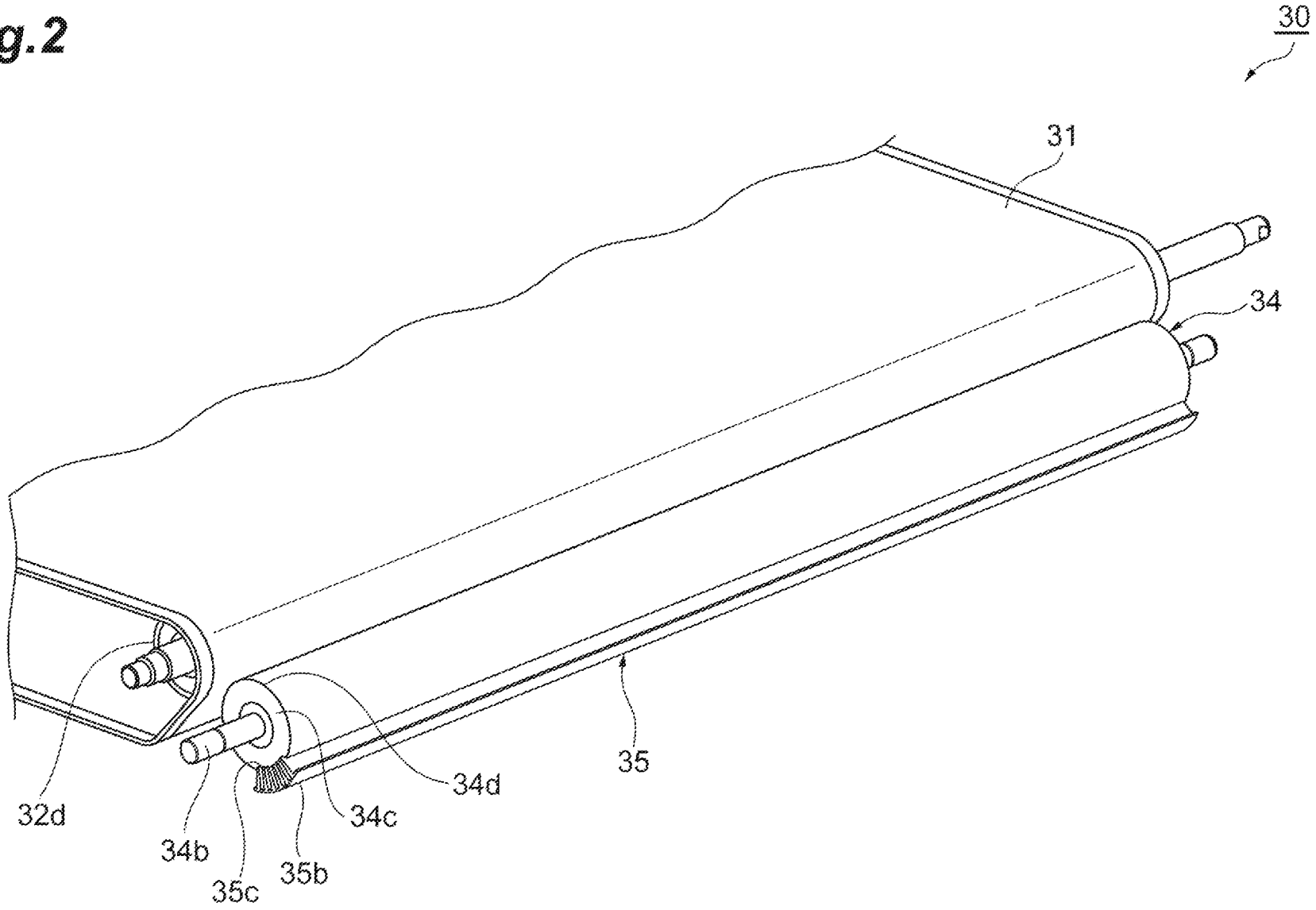
FIG. 2 is a perspective view illustrating an example transfer device of the imaging apparatus shown in FIG. 1.
Figure 3:
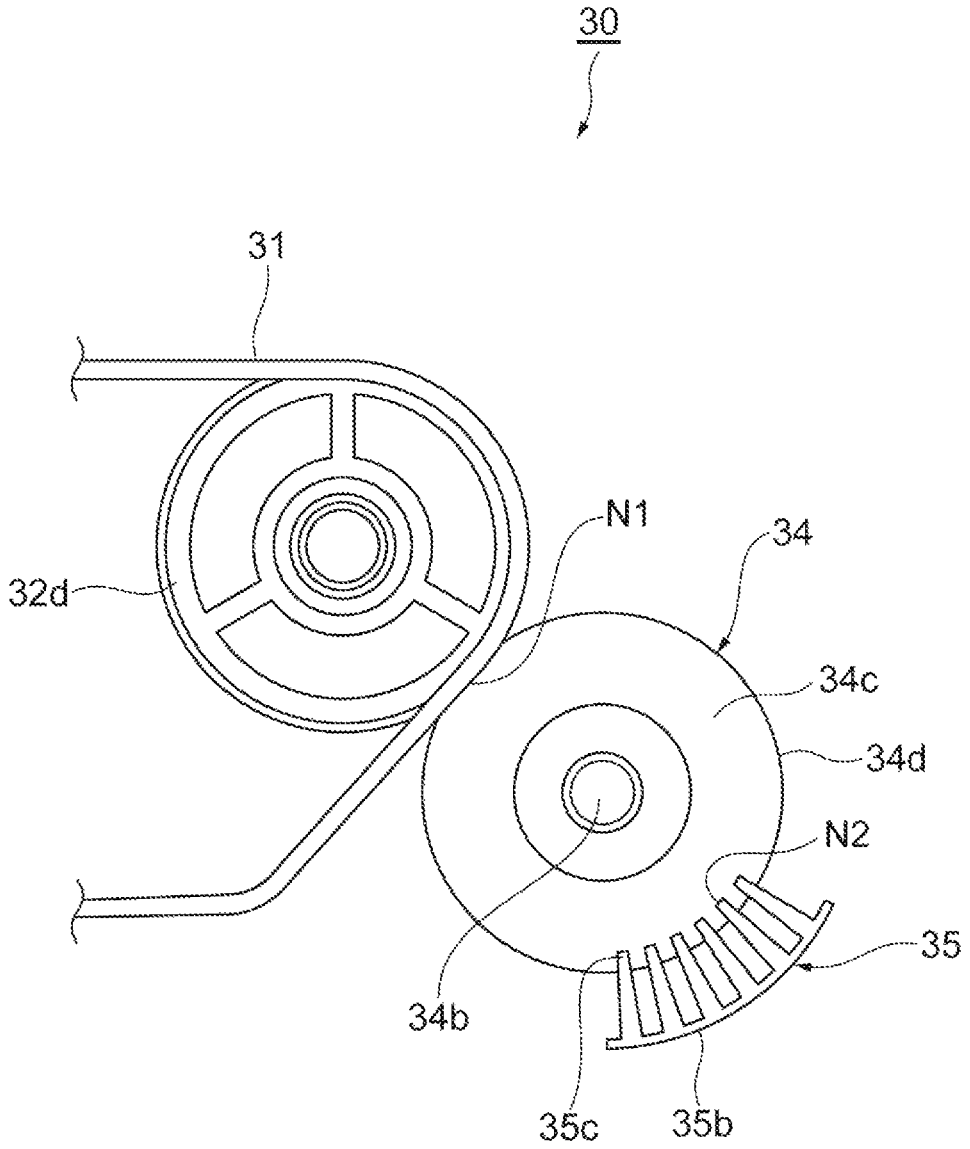
FIG. 3 is a side view of the transfer device illustrated in FIG. 2.

With reference to FIGS. 2 and 3, the transfer roller 34 of the transfer device 30 includes, for example, a shaft 34*b* and a foam layer 34*c* covering the shaft 34*b*. The foam layer 34*c* may be formed as independent cells or continuous cells. The shaft 34*b* is formed of metal and the foam layer 34*c* is formed of a highly flexible material. The foam layer 34*c* is formed in, for example, a sponge shape. A surface 34*d* of the transfer roller 34 is formed as a foam and a plurality of fine holes are formed in the surface 34*d* of the foam layer 34*c*.

The shaft 34*b* electrically floats during an imaging operation. The term "electric floating" may refer to a state in which a potential is independent. The transfer roller 34 forms a first nip N1 between the transfer belt 31 and the transfer roller 34, and the toner image is transferred from the transfer belt 31 onto the printing medium P when the printing medium P passes through the first nip N1. The transfer roller 34 contains an ion conductive agent.

The transfer device 30 includes a conductive device 35 which contacts the transfer roller 34. The conductive device 35 functions as, for example, a power supply member that supplies power to the transfer roller 34, from an outside of the transfer roller 34. The conductive device 35 has an electrical resistance lower than that of the transfer roller 34.

The conductive device 35 is formed in, for example, a brush shape. The conductive device 35 includes, for example, a metallic base portion 35*b* and a brush 35*c* which is fixed to the base portion 35*b* and contacts the surface 34*d* of the transfer roller 34. As an example, the base portion 35*b* extends in a substantially flat shape along the circumferential direction of the transfer roller 34. The conductive device 35 physically or mechanically cleans the toner of the surface 34*d* by contacting the surface 34*d* of the transfer roller 34.

Figure 4:
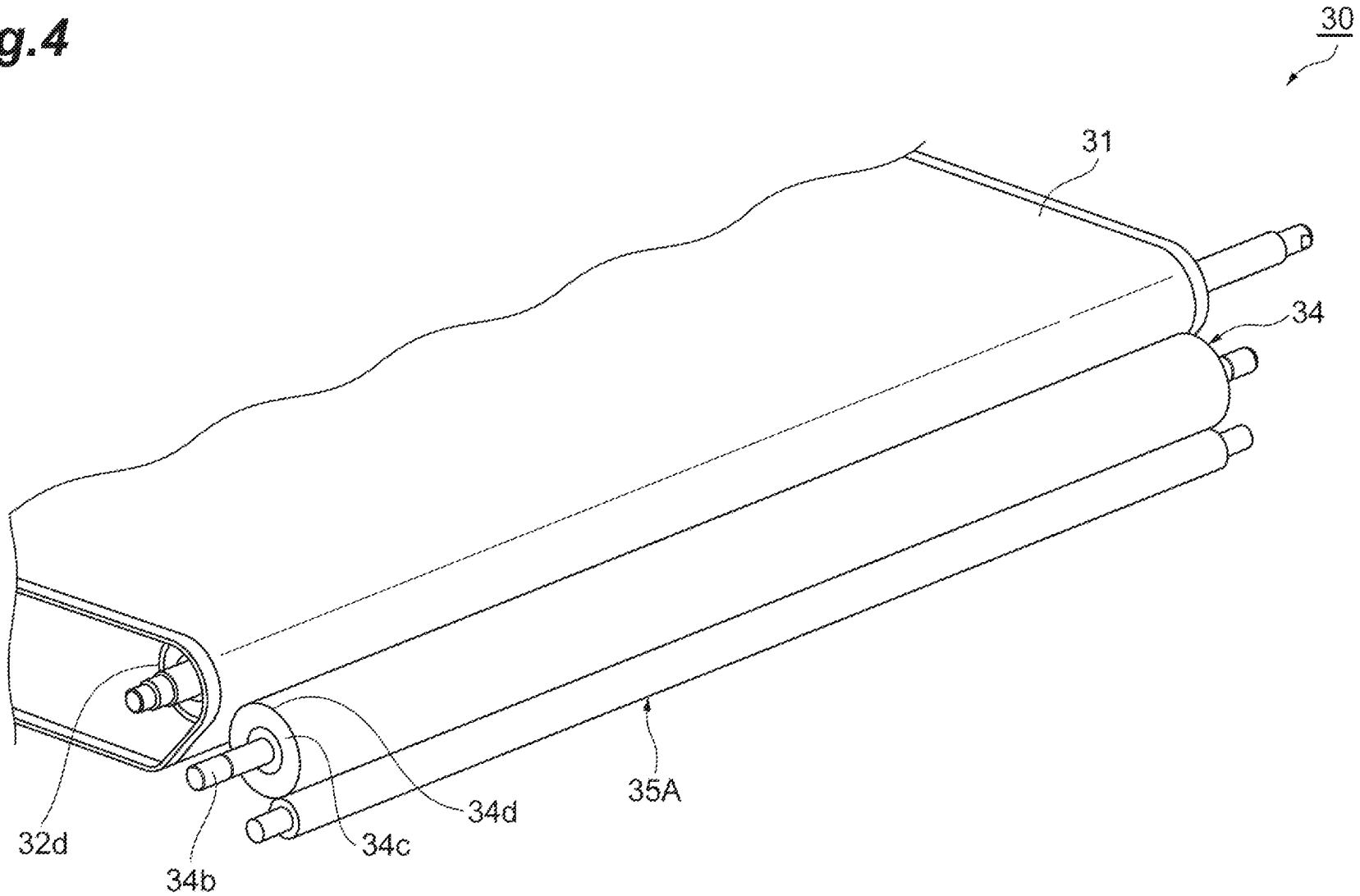
FIG. 4 is a perspective view illustrating an example transfer unit or device.
Figure 5:
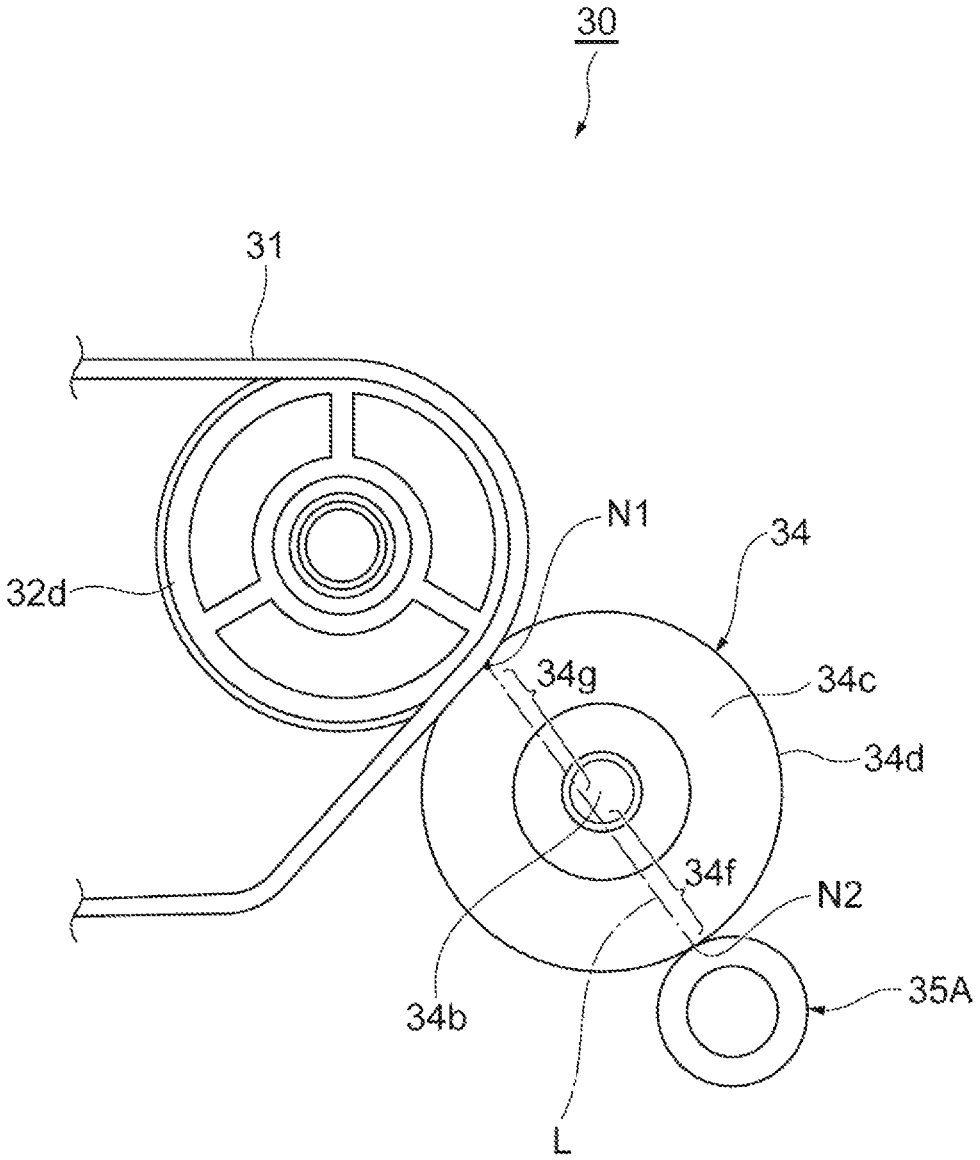
FIG. 5 is a side view of the transfer device illustrated in FIG. 4.

FIGS. 4 and 5 illustrate the transfer device 30 according to a modified example. The example transfer device 30 includes a transfer roller 34, as described above, and a roll-shaped conductive device 35A contacting the transfer roller 34. The conductive device 35A forms a second nip N2 between the transfer roller 34 and the conductive device 35A. The nip pressure at the second nip N2 may be less than the nip pressure at the first nip N1.

The conductive device 35A may be a cleaning roller having a circular cross-sectional shape and may rotate to follow the rotation of the transfer roller 34. In addition, the transfer roller 34 and the conductive device 35A may be disposed so that a line L corresponding to an imaginary line passing through the first nip N1 and the second nip N2 passes through (intersects) the shaft 34*b*.

Figure 6:
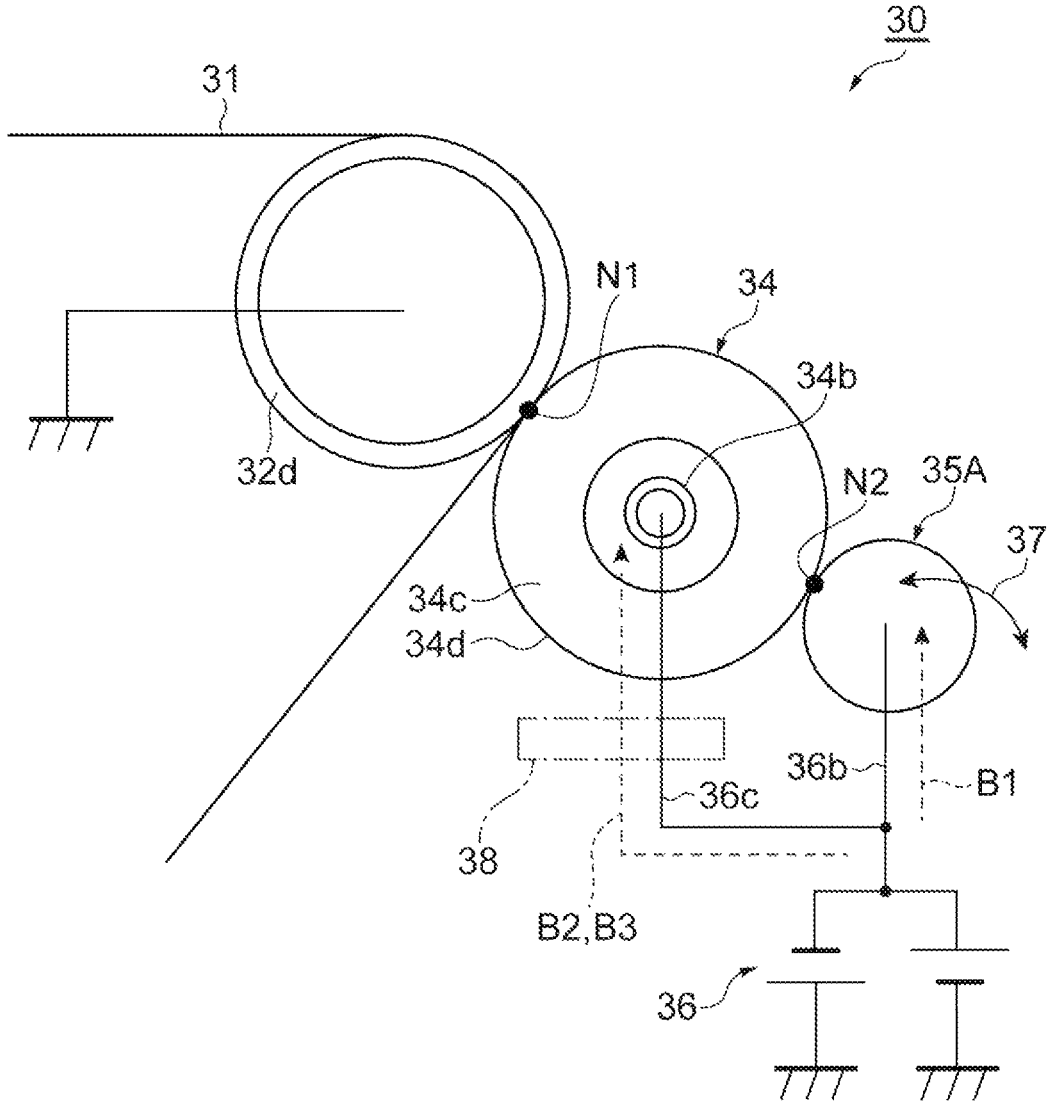
FIG. 6 is a schematic diagram illustrating a transfer roller, a conductive device, and a power source in the example transfer device.

FIG. 6 is a schematic diagram illustrating an example configuration, from a side view, of the tension roller 32*d*, the transfer belt 31, the transfer roller 34, and the conductive device 35A. As schematically illustrated in FIG. 6, the tension roller 32*d* is electrically grounded. As an example, the transfer device 30 includes a power source 36 which supplies a first electrical bias B1 to the conductive device 35A and supplies a second electrical bias B2 and a third electrical bias B3 to the transfer roller 34.

In some examples, the first electrical bias B1 may have a transfer electrical bias voltage for transferring the toner onto the printing medium P and the second electrical bias B2 may have a cleaning electrical bias voltage for cleaning the toner of the transfer roller 34. Further, the third electrical bias B3 may have an electrical-resistance-measurement electrical bias voltage for measuring the electrical resistance of the transfer roller 34.

The power source 36 is electrically grounded, and is electrically connected to the shaft 34*b* of the transfer roller 34 and to the conductive device 35A. The power source 36 includes a first supply path 36*b* which supplies the first electrical bias B1 to the conductive device 35A and a second supply path 36*c* which supplies the second electrical bias B2 or the third electrical bias B3 to the transfer roller 34. The power source 36 supplies the first electrical bias B1 to the conductive device 35A during an imaging operation and supplies the second electrical bias B2 to the transfer roller 34 during a cleaning operation. Further in one example, the power source 36 supplies the third electrical bias B3 to the transfer roller 34 during a measurement of the electrical resistance of the transfer roller 34.

In the example, if the toner is negatively charged, the power source 36 supplies a positive first electrical bias B1 to the transfer roller 34 through the conductive device 35A (applies the electrical bias voltage thereto) so that the toner is adsorbed to the printing medium P and the toner image is transferred onto the printing medium P. In addition, if the toner is negatively charged, the power source 36 supplies, for example, a negative second electrical bias B2 to the transfer roller 34 to remove the toner attached to the transfer roller 34. When the power source 36 supplies a positive third electrical bias B3 to the transfer roller 34, the electrical resistance of the transfer roller 34 is measured.

The transfer device 30 may include a contact-separation mechanism 37 which causes the conductive device 35A to contact the transfer roller 34 and to be separated therefrom. For example, the contact-separation mechanism 37 causes the conductive device 35A to be separated from the transfer roller 34 when the second electrical bias B2 or the third electrical bias B3 is supplied to the transfer roller 34 and causes the conductive device 35A to contact the transfer roller 34 when the first electrical bias B1 is supplied to the conductive device 35A. Since the conductive device 35A contacts the transfer roller 34 when the first electrical bias B1 is supplied, the first electrical bias B1 is supplied from the outside of the transfer roller 34 toward the shaft 34*b* of the transfer roller 34 through the surface 34*d*.

The transfer device 30 may include a blocking member 38 that physically or mechanically blocks the second supply path 36*c* when the conductive device 35A contacts the transfer roller 34. The term "physical blocking", which may include a "mechanical blocking", may indicate a state in which an object is blocked or obstructed from passing the path. The blocking member 38 may include, for example, an arm member that is provided in a part of the housing 3. As an example, the blocking member 38 is inserted between the shaft 34*b* and a spring located at one end of the shaft 34*b* in the axial direction so as to electrically isolate the shaft 34*b*.

Figure 7:
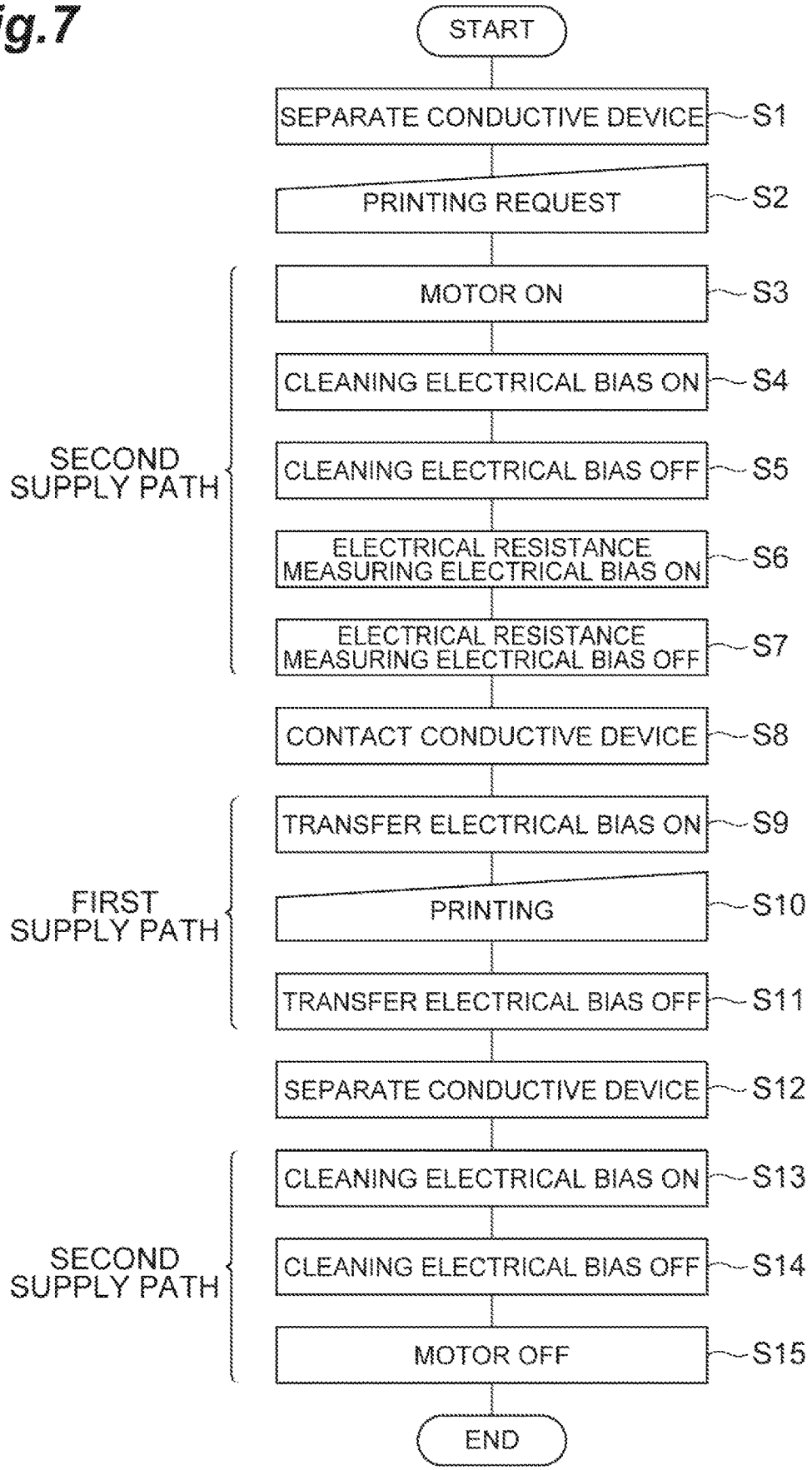
FIG. 7 is a flowchart illustrating example operations carried out by the transfer device illustrated in FIG. 6.

An example of a transferring operation and a cleaning operation of the transfer device 30 of FIG. 6 will be described with reference to the flowchart of FIG. 7. In an initial state, the conductive device 35A is separated or spaced apart from the transfer roller 34 by the contact-separation mechanism 37 (operation S1). When a printing request is input in this state, a motor inside the imaging apparatus 1 starts to operate (operations S2 and S3).

When the operation of the motor starts, the power source 36 supplies the second electrical bias B2 to the transfer roller 34 so as to clean the transfer roller 34 (operation S4). After the transfer roller 34 is cleaned completely, the power source 36 supplies the third electrical bias B3 to the transfer roller 34 and the electrical resistance of the transfer roller 34 is measured (operations S5 and S6).

After the electrical resistance of the transfer roller 34 is measured, the contact-separation mechanism 37 causes the conductive device 35A to contact the transfer roller 34 (operations S7 and S8). Then, in a state in which the conductive device 35A contacts the transfer roller 34, the power source 36 supplies the first electrical bias B1 to the conductive device 35A so that the imaging apparatus 1 starts a printing operation (operations S9 and S10). At this time, the second supply path 36*c* is electrically and/or physically blocked by the blocking member 38.

After the printing operation ends, the power source 36 stops the supply of the first electrical bias B1 to the conductive device 35A and the contact-separation mechanism 37 causes the conductive device 35A to be separated (spaced apart) from the transfer roller 34 (operations S11 and S12). Then, in a state in which the blocking of the second supply path 36*c* by the blocking member 38 is cancelled or stopped, the power source 36 supplies the second electrical bias B2 to the transfer roller 34 so as to perform a cleaning operation (operation S13). After the transfer roller 34 is cleaned in this way, the operation of the motor inside the imaging apparatus 1 is stopped and a series of operations are completed (operations S14 and S15).

Figure 8:
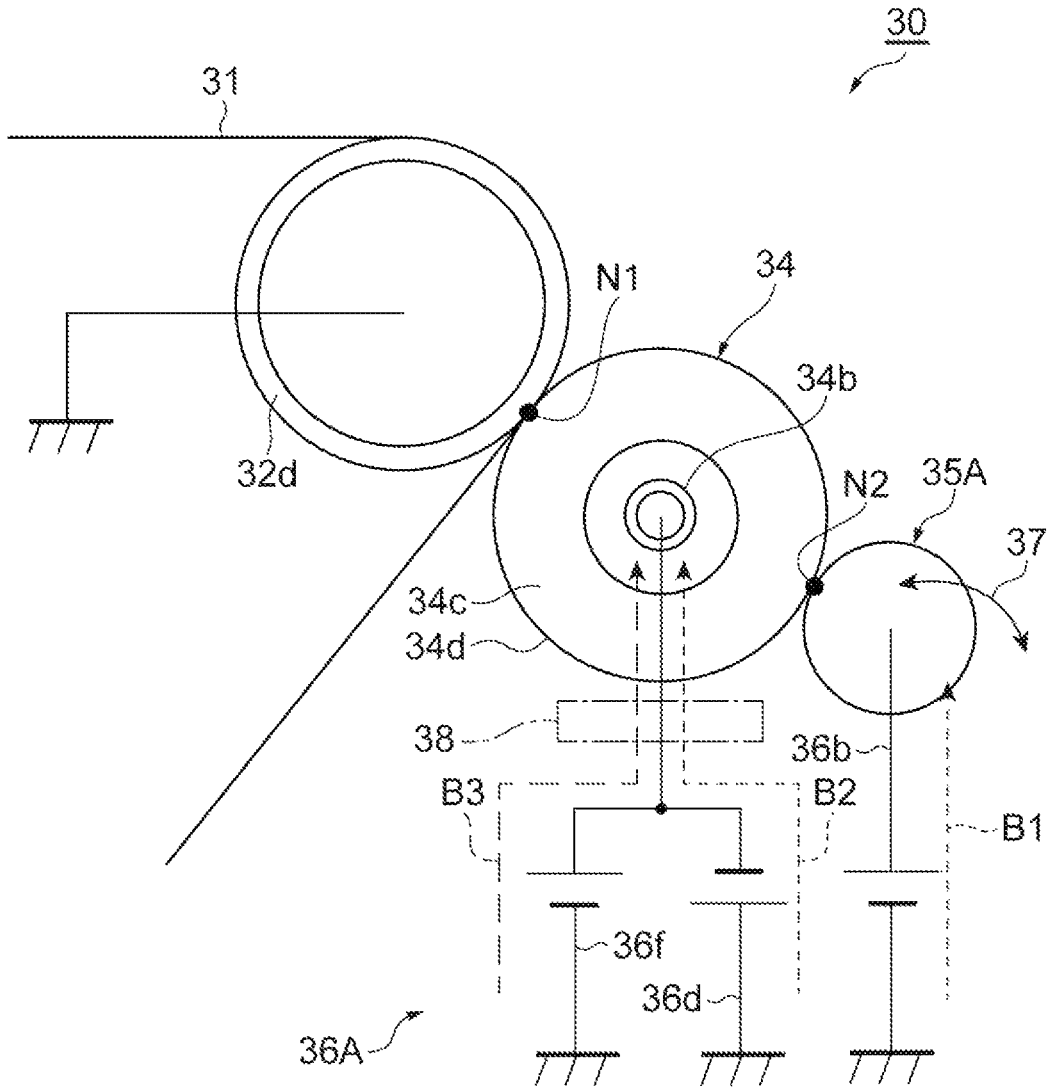
FIG. 8 is a schematic diagram illustrating an example transfer device.

FIG. 8 is a schematic diagram illustrating, from a side view, a configuration of the tension roller 32*d*, the transfer belt 31, the transfer roller 34, the conductive device 35A, and a power source 36A according to a modified example. In the description below relating to FIG. 8, the description of features that are similar to those of FIG. 6, may be omitted. The power source 36A includes a first supply path 36*b* which supplies the first electrical bias B1 to the conductive device 35A, a second supply path 36*d* which supplies the second electrical bias B2 to the transfer roller 34, and a third supply path 36*f* which supplies the third electrical bias B3 to the transfer roller 34.

Figure 9:
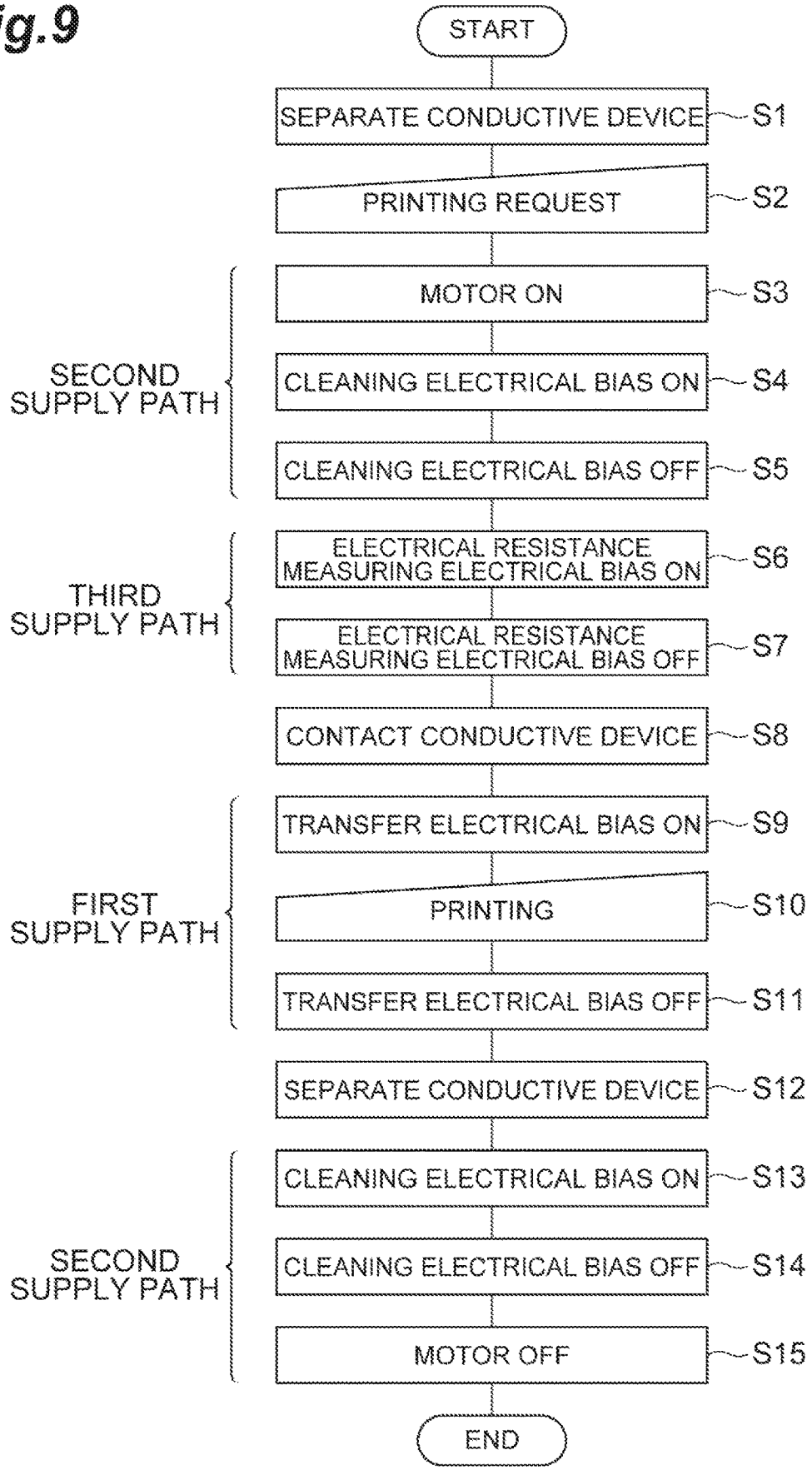
FIG. 9 is a flowchart illustrating example operations carried out by the transfer device illustrated in FIG. 8.

FIG. 9 is a flowchart illustrating an example of a transferring operation and a cleaning operation of the transfer device 30 of FIG. 8. As illustrated in FIG. 9, the transfer device 30 performs a series of operations similarly to the example illustrated in FIG. 7. In the example of FIG. 9, in a state in which the conductive device 35A is separated or spaced apart from the transfer roller 34, the power source 36A supplies the second electrical bias B2 to the transfer roller 34 through the second supply path 36*d* so as to perform a cleaning operation (operations S1 to S4). Subsequently, the power source 36A supplies the third electrical bias B3 to the transfer roller 34 through the third supply path 36*f* so as to measure the electrical resistance (operations S5 and S6).

After the electrical resistance of the transfer roller 34 is measured, the contact-separation mechanism 37 causes the conductive device 35A to contact the transfer roller 34 and the blocking member 38 blocks the second supply path 36*d* and the third supply path 36*f*. Then, the power source 36A supplies the first electrical bias B1 to the conductive device 35A so that the imaging apparatus 1 performs a printing operation (operations S7 to S10). Subsequently, a series of operations are carried out similarly to those described with reference to FIG. 7.

In the example imaging apparatus 1 having the above-described configuration, the nip pressure at the second nip N2 between the transfer roller 34 and the conductive device 35A is lower than the nip pressure at the first nip N1 between the transfer roller 34 and the transfer belt 31. Since the nip pressure of the second nip N2 between the transfer roller 34 and the conductive device 35A is lower, it is possible to suppress the surface 34*d* of the transfer roller 34 from being depressed, and thus protect the surface of 34*d* and the shape of the transfer roller 34.

When the surface 34*d* of the transfer roller 34 is provided by a foam layer 34*c*, the surface 34*d* of the transfer roller 34 can be in close contact with the printing medium P along a broad area. The foam layer 34*c*, which is provided on the surface 34*d* of the transfer roller 34, may be provided without any resin coating or other covering of the foam layer, and therefore an increase in cost of the transfer roller or manufacturing operation of applying the resin coating may be suppressed.

Figure 10:
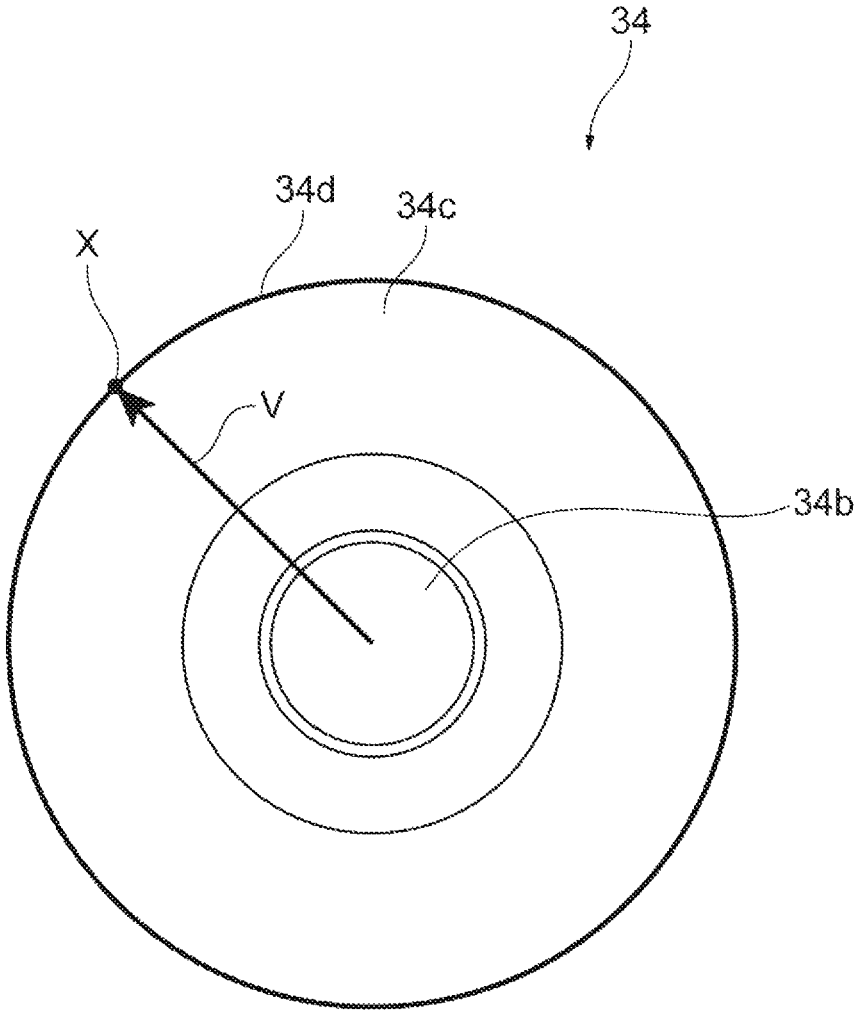
FIG. 10 is a schematic diagram illustrating an example of a flow of current in a transfer roller of a transfer device according to a comparative example.

The transfer roller 34 may contain an ion conductive agent. With reference to FIG. 10, in the case of a comparative example in which an electrical bias voltage V is continuously applied to the shaft 34*b* of the transfer roller 34, an ion conductive agent X moves from the shaft 34*b* of the transfer roller 34 toward the surface 34*d* (e.g., the outside of the transfer roller 34 in a radial direction with respect to a rotational axis of the transfer roller) so that the ion conductive agent X is unevenly distributed to the surface 34*d*. Since the ion conductive agent X is unevenly distributed to the surface 34*d*, a current hardly flows (e.g., the flow of current is inhibited). As a result, the electrical resistance of the transfer roller 34 may increase.

Figure 11:
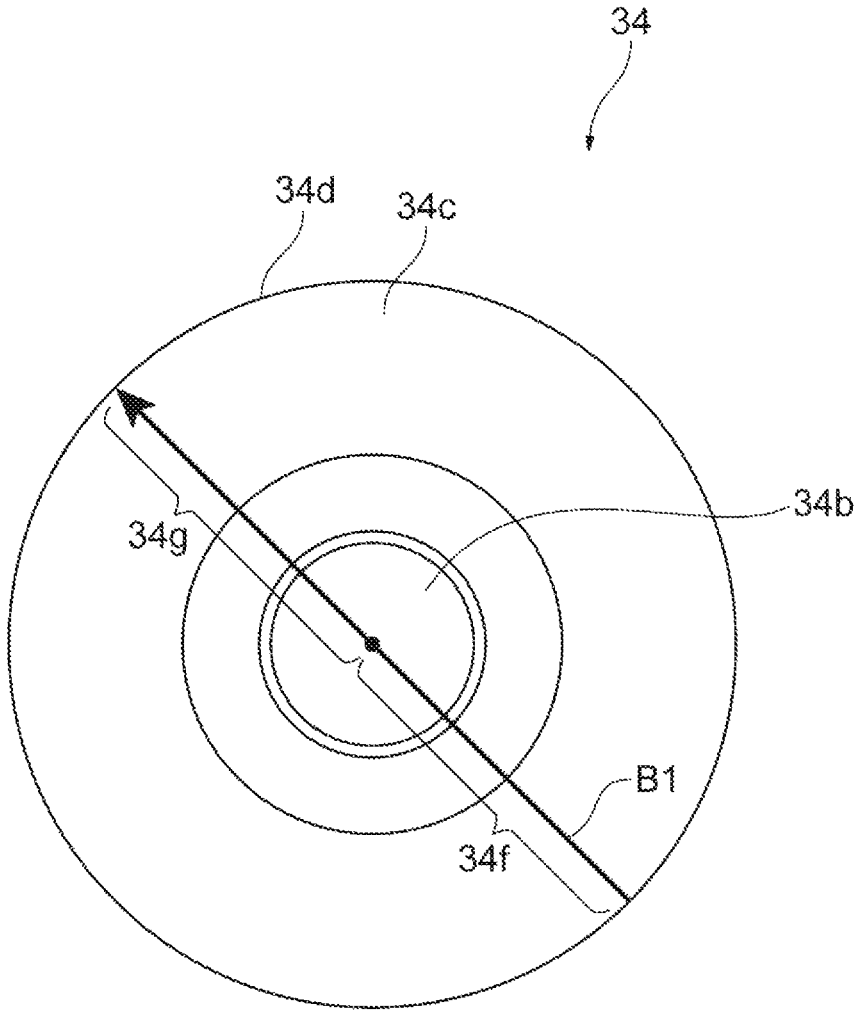
FIG. 11 is a schematic diagram illustrating an example of a flow of current in an example transfer roller of an example transfer device.

With reference to FIG. 11, in the transfer roller 34, in accordance with the above-described examples, the power source 36 supplies the first electrical bias B1 from the outside to the transfer roller 34 through the conductive device 35A during the imaging operation (the transferring operation with respect to the printing medium P). Thus, a first path 34*f* extending from the surface 34*d* toward the shaft 34*b* (e.g., the inside of the transfer roller 34 in the radial direction) and a second path 34*g* extending from the shaft 34*b* toward the surface 34*d* are formed as the path supplying the electrical bias voltage to the transfer roller 34.

Figure 12:
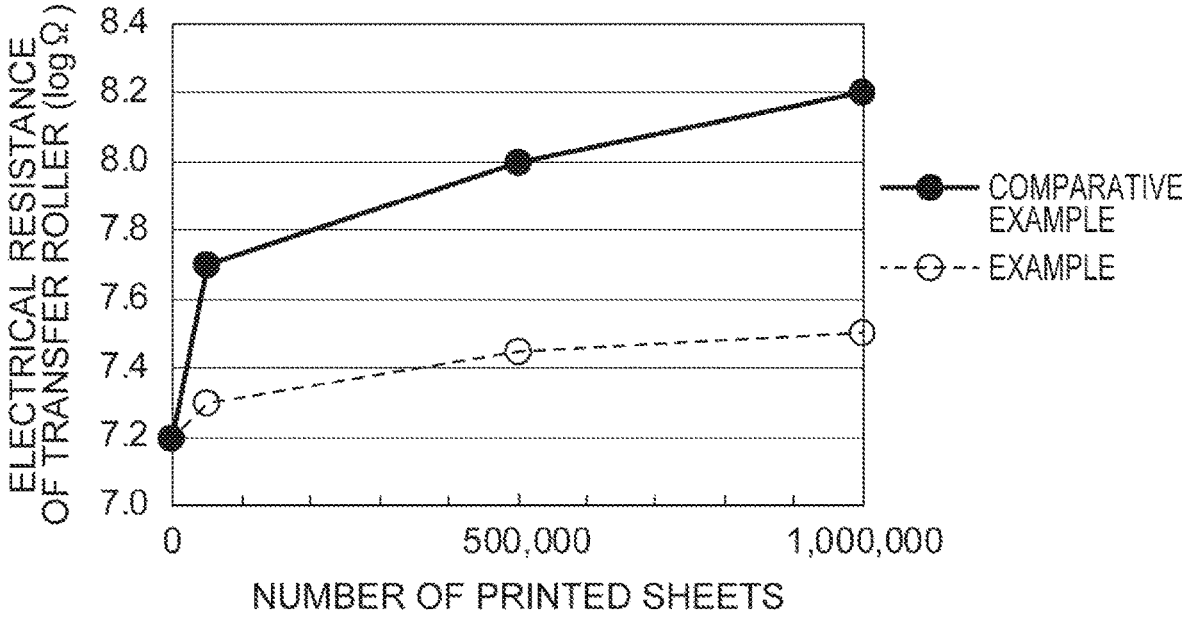
FIG. 12 is a graph showing the number of printed sheets in relation to the electrical resistance for the example transfer roller and for the comparative example.

Accordingly, the ion conductive agent X is more evenly distributed to the surface 34*d*, which inhibits the electrical resistance of the transfer roller 34 from increasing. With reference to the graph of FIG. 12, in a case in which the electrical bias is continuously applied to the shaft 34*b* according to the comparative example, the electrical resistance of the transfer roller 34 increases from 7.2 (log Q) to 7.7 (log Q) when 50,000 sheets are printed and the electrical resistance reaches 8.2 (log Q) at a time point in which 1,000,000 sheets are printed.

In contrast, in the case of the example in which the first electrical bias B1 is supplied to the transfer roller 34 through the conductive device 35A during the imaging operation, the electrical resistance just increases by a small amount from 7.2 (log Q) to 7.5 (log Q) even when 1,000,000 sheets are printed. Accordingly, an increase in the electrical resistance of the transfer roller 34 is more reliably suppressed.

With reference to FIG. 5, the transfer roller 34 may include a metal shaft 34*b* and the first nip N1 and the second nip N2 may be disposed on the line L that intersects (e.g., passing through) the shaft 34*b*, in order to more reliably form the first path 34*f* of the electrical bias voltage from the surface 34*d* toward the shaft 34*b* and the second path 34*g* of the electrical bias voltage from the shaft 34*b* toward the surface 34*d*, and accordingly an increase in the electrical resistance of the transfer roller 34 may be more reliably suppressed.

With reference to FIGS. 6 and 8, the conductive device 35A may be separable from the transfer roller 34. For example, during the cleaning operation or the electrical resistance measuring operation, the contact-separation mechanism 37 may cause the conductive device 35A to be separated (e.g., spaced apart) from the transfer roller 34, in order to inhibit a deformation of the transfer roller 34.

The power source 36 may supply the first electrical bias B1 to the conductive device 35A through the first supply path 36*b* when the conductive device 35A contacts the transfer roller 34 and may supply the second electrical bias B2 to the transfer roller 34 through the second supply path 36*c* when the conductive device 35A is separated (e.g., moved away or spaced apart) from the transfer roller 34.

In this case, power is supplied from the outside to the transfer roller 34 through the conductive device 35A during the imaging operation and power is directly supplied to the transfer roller 34 separated (spaced apart) from the conductive device 35A during an operation other than the imaging operation (for example, the cleaning operation or the electrical resistance measuring operation). Thus, the power supply path to the transfer roller 34 can be clearly defined whether for the imaging operation or for operations other than the imaging operation, in order to improve the reliability of the supply of the electrical bias voltage.

The transfer device 30 may include the blocking member 38 that physically blocks the second supply path 36*c* when the conductive device 35A contacts the transfer roller 34. When the electrical bias voltage supply path is electrically switched by the switching, an electrical noise may be generated during the switching operation. Accordingly, in a case in which the blocking member 38 physically blocks the second supply path 36*c*, the blocking member 38 mechanically blocks the second supply path 36*c* when the first electrical bias B1 is supplied to the conductive device 35A through the first supply path 36*b*, so as to improve the reliability of the supply of the electrical bias voltage.

The housing 3 may include the blocking member 38. For example, the blocking member 38 may be a part of the housing 3. In this case, a part of the housing 3 can be effectively used as a portion which blocks the second supply path 36*c* to the transfer roller 34.

The second electrical bias B2 may be supplied to the shaft 34*b* of the transfer roller 34 and the first electrical bias B1 supplied to the conductive device 35A may be supplied from a portion contacting the conductive device 35A in the surface 34*d* of the transfer roller 34 to the shaft 34*b*. The first electrical bias B1 is supplied from the surface 34*d* toward the shaft 34*b*, in order to more reliably reduce an uneven distribution of the ion conductive agent to the surface 34*d*.

The power source 36 may supply the third electrical bias B3 to the transfer roller 34 through the second supply path 36*c* at the time of measuring the electrical resistance of the transfer roller 34. Since the third electrical bias B3 for measuring the electrical resistance is supplied through the second supply path 36*c*, the second supply path 36*c* can be effectively used to measure the electrical resistance, in order to simplify a configuration of the power source 36.

With reference to FIG. 3, the conductive device 35 of the transfer device 30 may be a conductive brush, in order to physically scrape off the toner of the transfer roller 34 by the conductive device 35 supplying the first electrical bias B1 to the transfer roller 34. Thus, the conductive device 35 supplying the first electrical bias B1 can be effectively used as a cleaning brush. As described above, the conductive device 35A of the transfer device 30 may be a conductive roller, such as a metallic rigid body, for example.

Further, as described above, the transfer roller 34 of the transfer device 30 may be a secondary transfer roller which transfers a composite toner image, in order to enhance the above-described effect in the secondary transfer roller 34.

Figure 13:
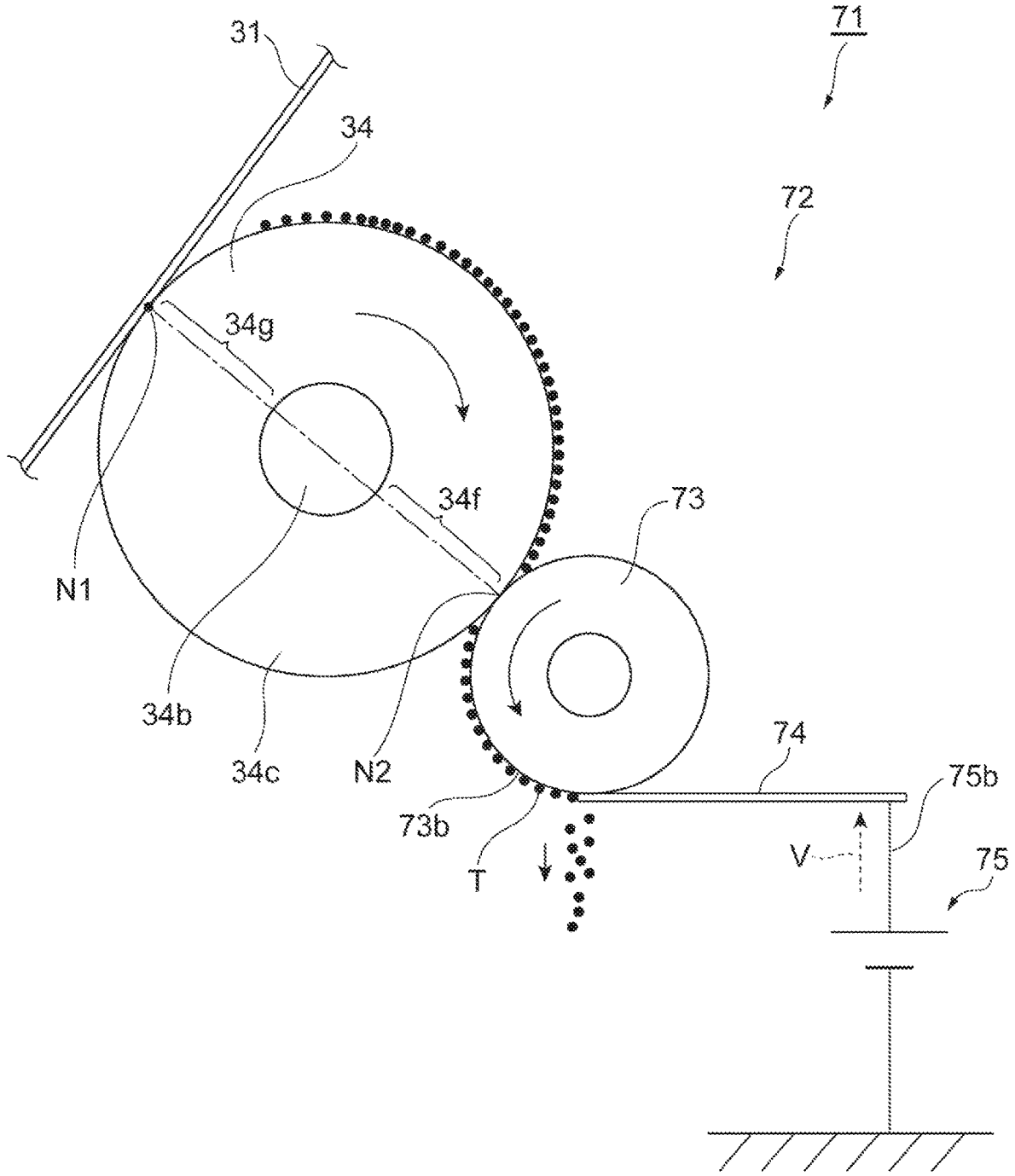
FIG. 13 is a schematic diagram illustrating an example transfer device.

An imaging apparatus 71 according to a modified example will be described with reference to FIG. 13. In the description below relating to FIG. 11, the description of features that are similar to those of the imaging apparatus 1 may be omitted. The imaging apparatus 71 includes a transfer unit (or transfer device) 72 which includes the transfer roller 34.

The transfer device 72 further includes a conductive roller 73 which is provided adjacent to the transfer roller 34, a conductive scraping member 74 that scrapes off toner T from the conductive roller 73, and a power source 75 which supplies an electrical bias voltage to the conductive scraping member 74. The transfer roller 34 is provided adjacent to the transfer belt 31 and forms the first nip N1 between the transfer belt 31 and the transfer roller 34.

The conductive roller 73 is provided adjacent to the transfer roller 34 and forms the second nip N2 between the transfer roller 34 and the conductive roller 73. The conductive scraping member 74 is a conductive scraper which scrapes off the toner T attached to the conductive roller 73 when the conductive roller 73 rotates. For example, the conductive scraping member 74 is disposed so as to face a surface 73*b* of the conductive roller 73 and to extend along a tangent line of the surface 73*b* of the conductive roller 73.

The power source 75 is electrically grounded and is electrically connected to the conductive scraping member 74. The power source 75 includes a supply path 75*b* which supplies an electrical bias voltage V to the conductive scraping member 74. The power source 75 supplies the electrical bias voltage V to the conductive scraping member 74 during the cleaning operation. The electrical bias voltage V is a cleaning electrical bias for cleaning the transfer roller 34 and the conductive roller 73.

For example, the power source 75 supplies the positive electrical bias voltage V to the conductive scraping member 74 when the toner T is negatively charged. The positive electrical bias voltage V is applied to the conductive roller 73 through the conductive scraping member 74. Then, the toner T attached to the transfer roller 34 is adsorbed to the conductive roller 73 by the electrical bias voltage V applied to the conductive roller 73. The toner T adsorbed to the conductive roller 73 is physically scraped off by the conductive scraping member 74.

In the above-described example, the imaging apparatus 71 includes the conductive scraping member 74 that scrapes off the toner T from the conductive roller 73 contacting the transfer roller 34 and the power source 75 which supplies the electrical bias voltage V to the conductive scraping member 74. Accordingly, the power source 75 can supply the electrical bias voltage V to the conductive roller 73 through the conductive scraping member 74 so that the toner T is adsorbed to the conductive roller 73 and the toner T adsorbed to the conductive roller 73 is physically scraped off by the conductive scraping member 74.

Since the toner T is adsorbed and scraped off by the conductive scraping member 74, the toner T of the transfer roller 34 may be returned to the transfer belt 31 in order to perform the cleaning operation, without any electrical bias voltage (for example, the negative cleaning electrical bias), and accordingly, the configuration of the power source 75 may be simplified. In addition, since the electrical bias voltage for returning the toner T from the transfer roller 34 is omitted and accordingly an operation of reversing of the polarity of the electrical bias voltage is omitted, a time saving substantially corresponding to a duration for reversing the polarity of the electrical bias voltage, contributes to an increase in the printing speed.

Further, the first path 34*f* extending from the surface 34*d* toward the shaft 34*b* and the second path 34*g* extending from the shaft 34*b* toward the surface 34*d* are formed as the path that supplies the electrical bias voltage V to the transfer roller 34 as described above, in order to inhibit the ion conductive agent from being unevenly distributed to the surface 34*d*, so as to inhibit an increase in the electrical resistance of the transfer roller 34.

As described above, the conductive scraping member 74 may be a conductive scraper that scrapes off the toner T attached to the conductive roller 73, such that the toner T can be physically scraped off by the conductive scraping member 74 supplying the electrical bias voltage V to the conductive roller 73 and the transfer roller 34. Thus, the conductive scraping member 74 that physically scrapes off the toner T of the surface 73*b* of the conductive roller 73 can be effectively used as the conductive device supplying the electrical bias voltage V.

Figure 14:
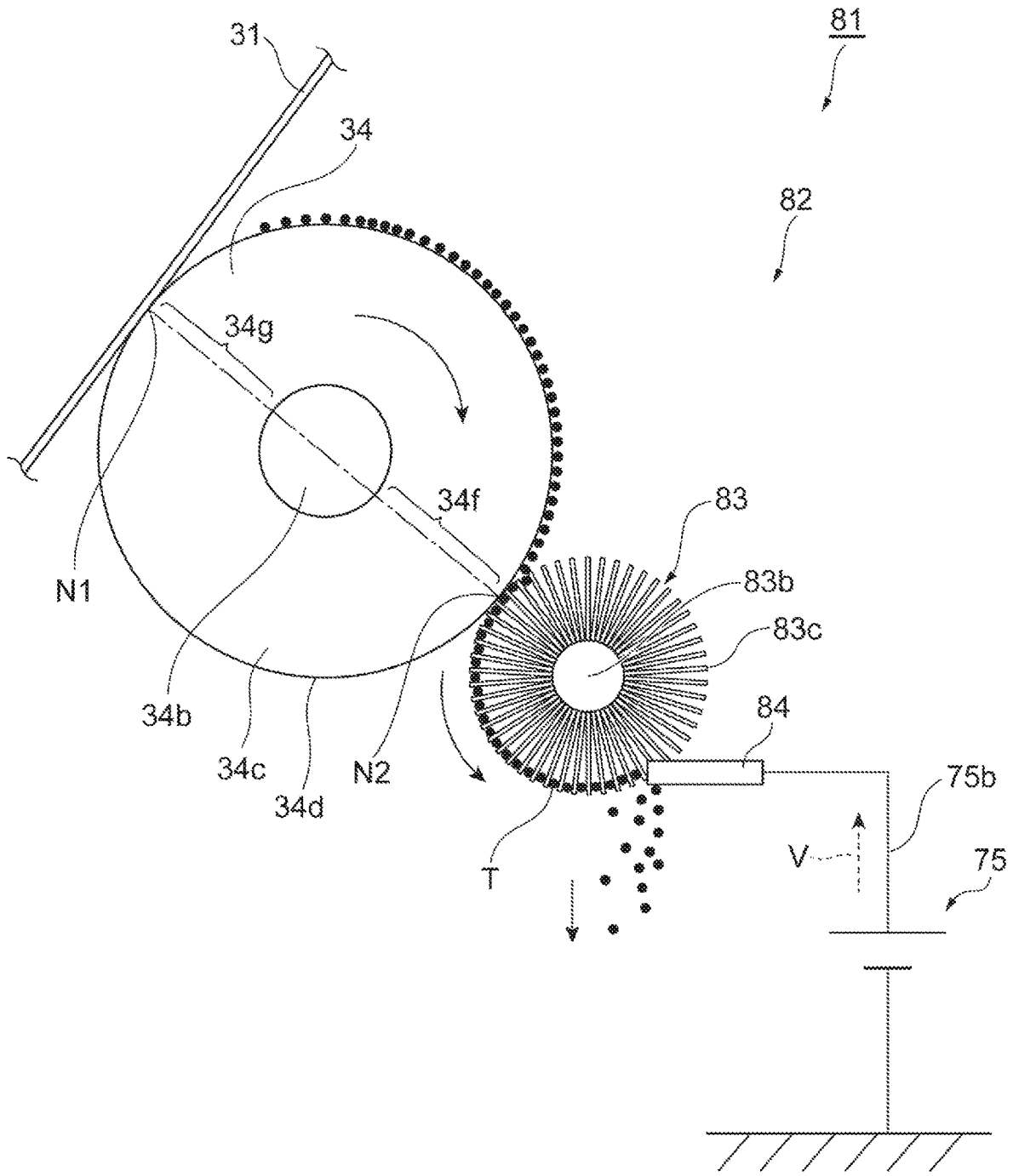
FIG. 14 is a schematic diagram illustrating an example transfer device.

An imaging apparatus 81 according to another modified example will be described with reference to FIG. 14. The imaging apparatus 81 includes a transfer unit (or transfer device) 82 which includes a conductive brush 83 and a conductive scraping member 84 instead of the conductive roller 73 and the conductive scraping member 74. In the description below relating to FIG. 14, the description of features that are similar to those of the imaging apparatus 71 of FIG. 13, may be omitted.

The conductive brush 83 is provided adjacent to the transfer roller 34 and adsorbs the toner T of the surface 34*d* of the transfer roller 34. The conductive brush 83 may be, for example, a brush roller. As an example, the conductive brush 83 includes a metallic shaft portion 83*b* and bristles 83*c* fixed to the shaft portion 83*b*.

The conductive scraping member 84 may be, for example, a conductive flicker that drops the toner T adsorbed to the conductive brush 83 from the conductive brush 83. A part of the conductive scraping member 84 may extend into the bristles 83*c* of the conductive brush 83. For example, the conductive scraping member 84 may be provided at a position so as to bite into the rotating bristles 83*c*.

As an example, the conductive scraping member 84 is formed in a plate shape, and the toner T attached to the bristles 83*c* is scraped off by the conductive scraping member 84 as the bristles 83*c* rotates. The power source 75 is electrically connected to the conductive scraping member 84 and the power source 75 includes the supply path 75*b* supplying the electrical bias voltage V to the conductive scraping member 84.

As described above, the imaging apparatus 81 includes the conductive scraping member 84 that scrapes off the toner T from the conductive brush 83 contacting the transfer roller 34 and the power source 75 which supplies the electrical bias voltage V to the conductive scraping member 84. Thus, the power source 75 can supply the electrical bias voltage V to the conductive brush 83 through the conductive scraping member 84 so that the toner T is adsorbed to the conductive brush 83 and the toner T adsorbed to the conductive brush 83 is scraped off by the conductive scraping member 84.

Since the toner T is adsorbed and scraped off by the conductive scraping member 84, the cleaning operation may be performed without any electrical bias voltage for returning the toner T of the transfer roller 34 to the transfer belt 31, and thus similar effects as those of the imaging apparatus 71, may be obtained in the imaging apparatus 81.

Further, the conductive brush 83 is a brush roller and the conductive scraping member 84 may be a conductive flicker that scrapes off the toner T attached to the conductive brush 83. Accordingly, the toner T may be adsorbed to individual bristles 83*c* of the conductive brush 83 and the toner T on the bristles 83*c* can be scraped off by the conductive flicker, to more efficiently clean the toner T of the transfer roller 34.

It is to be understood that not all aspects, advantages and features described herein may necessarily be achieved by, or included in, any one particular example. Indeed, having described and illustrated various examples herein, it should be apparent that other examples may be modified in arrangement and detail is omitted. In some examples, the transfer roller may be a primary transfer roller, and in some examples, the imaging apparatus may be one forming a black and white image.

The invention claimed is:

1. An imaging apparatus comprising:
a transfer belt;
a transfer roller including a metal shaft electrically floating during an imaging operation;
a conductive device having an electrical resistance lower than an electrical resistance of the transfer roller; and
a power source electrically connected to the conductive device, the power source including:
a first supply path to supply a first electrical bias to the conductive device during an imaging operation; and
a second supply path to supply a second electrical bias to the transfer roller during a cleaning operation.

2. The imaging apparatus according to claim 1, wherein
a first nip is formed between the transfer belt and the transfer roller,
a second nip is formed between the transfer roller and the conductive device,
a nip pressure of the second nip is lower than a nip pressure of the first nip, and
a line connecting the first nip and the second nip intersects the metal shaft.

3. The imaging apparatus according to claim 1, wherein the conductive device is movable toward and away from the transfer roller.

4. The imaging apparatus according to claim 3, wherein the power source is to supply the first electrical bias to the conductive device when the conductive device contacts the transfer roller, and to supply the second electrical bias to the transfer roller when the conductive device is spaced apart from the transfer roller.

5. The imaging apparatus according to claim 4, comprising:
a blocking member to physically block the second supply path when the conductive device contacts the transfer roller.

6. The imaging apparatus according to claim 5, comprising:
a housing that includes the blocking member.

7. The imaging apparatus according to claim 4, wherein the power source is to,
supply the second electrical bias to the shaft of the transfer roller, and
supply the first electrical bias supplied to the conductive device, to the shaft via a portion of a surface of the transfer roller that contacts the conductive device.

8. The imaging apparatus according to claim 1, wherein the power source is to supply a third electrical bias to the transfer roller through the second supply path when an electrical resistance of the transfer roller is measured.

9. The imaging apparatus according to claim 1, wherein the conductive device comprises a conductive brush.

10. The imaging apparatus according to claim 1, wherein the conductive device comprises a conductive roller.

11. An imaging apparatus comprising:
a transfer belt;
a transfer roller located adjacent the transfer belt, wherein a first nip is formed between the transfer belt and the transfer roller;
a conductive roller having an outer circumference of a metallic rigid body with a circular cross-sectional shape, the conductive roller located adjacent the transfer roller, wherein a second nip is formed between the transfer roller and the conductive roller;
a conductive scraping member to scrape off toner from the conductive roller; and
a power source to supply an electrical bias voltage to the conductive scraping member.

12. The imaging apparatus according to claim 11, wherein the transfer roller comprises a foam that forms a surface of the transfer roller.

13. The imaging apparatus according to claim 11, wherein the conductive scraping member comprises a conductive scraper to scrape off the toner from the conductive roller.

14. The imaging apparatus according to claim 11, wherein
the transfer roller includes a metal shaft, and
the first nip and the second nip are located along a line that intersects the shaft.

15. An imaging apparatus comprising:
a transfer belt;
a transfer roller including a metal shaft;
a conductive device to be in contact with and to be away from the transfer roller; and
a power source to:
supply a first electrical bias to the conductive device during an imaging operation; and
supply a second electrical bias to the transfer roller during a cleaning operation.

16. The imaging apparatus according to claim 15, wherein
a first nip is formed between the transfer belt and the transfer roller,
a second nip is formed between the transfer roller and the conductive device,
a nip pressure of the second nip is lower than a nip pressure of the first nip, and
a line connecting the first nip and the second nip intersects the metal shaft.

17. The imaging apparatus according to claim 15, wherein the conductive device comprises a conductive brush or a conductive roller.

18. The imaging apparatus according to claim 15, wherein the power source is to supply the first electrical bias to the conductive device based on the conductive device contacting the transfer roller, and to supply the second electrical bias to the transfer roller based on the conductive device being away from the transfer roller.

19. The imaging apparatus according to claim 18, comprising a blocking member to block the second electrical bias based on the conductive device contacting the transfer roller.

20. The imaging apparatus according to claim 18, wherein the power source is to, supply the second electrical bias to the shaft of the transfer roller, supply the first electrical bias supplied to the conductive device to the shaft via a portion of a surface of the transfer roller that contacts the conductive device, and supply a third electrical bias to the transfer roller based on an electrical resistance of the transfer roller being measured.

* * * * *